US008905590B2

(12) United States Patent
Stoneham

(10) Patent No.: US 8,905,590 B2
(45) Date of Patent: Dec. 9, 2014

(54) LINEAR WASH LAMP

(76) Inventor: Edward Bryant Stoneham, Los Altos, CA (US)

( * ) Notice: Subject to any disclaimer, the term of this patent is extended or adjusted under 35 U.S.C. 154(b) by 252 days.

(21) Appl. No.: 13/261,494

(22) PCT Filed: May 20, 2011

(86) PCT No.: PCT/US2011/037474

§ 371 (c)(1),
(2), (4) Date: Apr. 1, 2013

(87) PCT Pub. No.: WO2011/149795

PCT Pub. Date: Dec. 1, 2011

(65) Prior Publication Data

US 2013/0135872 A1 May 30, 2013

Related U.S. Application Data

(60) Provisional application No. 61/347,381, filed on May 22, 2010.

(51) Int. Cl.

| | |
|---|---|
| ***F21V 29/00*** | (2006.01) |
| ***F21V 7/00*** | (2006.01) |
| *F21S 8/04* | (2006.01) |
| *F21V 11/16* | (2006.01) |

(52) U.S. Cl.

CPC ..... *F21V 7/0091* (2013.01); *F21V 7/0008* (2013.01); *F21V 7/0025* (2013.01); *F21V 29/22* (2013.01); *F21S 8/04* (2013.01); *F21V 11/16* (2013.01)

USPC ..... 362/294; 362/147

(58) Field of Classification Search

CPC ..... F21S 8/024

USPC ..... 362/294, 147

See application file for complete search history.

(56) References Cited

U.S. PATENT DOCUMENTS

| | | | | |
|---|---|---|---|---|
| 4,028,542 | A | 6/1977 | McReynolds, Jr. | |
| 5,032,958 | A * | 7/1991 | Harwood | 40/559 |
| 6,454,442 | B1 * | 9/2002 | Changaris | 362/297 |
| 6,773,135 | B1 | 8/2004 | Packer | |
| 7,607,794 | B1 | 10/2009 | Thompson | |
| 2006/0152931 | A1 | 7/2006 | Holman | |
| 2009/0180159 | A1 | 7/2009 | Herloski | |
| 2012/0099300 | A1 * | 4/2012 | Napoli et al. | 362/147 |

* cited by examiner

*Primary Examiner* — Evan Dzierzynski

(57) ABSTRACT

A lamp assembly (500) may include a linear light-emitting array (100) and a reflecting surface (101) arranged to limit the angular distribution of direct light while supplementing with reflected light the intensity of the direct light on a flat surface (102) of an object being illuminated. The reflecting surface (101) may be shaped to cause the distribution of the total illumination over the illuminated portion of the flat surface (102) to be uniform or to be linearly tapered or to have another desired profile. The reflecting surface (101) may be part of a heat-sinking reflector (300) that may include a mounting surface (302), a blind (303), oblong mounting holes (304) allowing rotational adjustment, heat sink mounting holes (305), and/or one or more exit holes (307), and that may have end pieces (400) attached to it.

10 Claims, 9 Drawing Sheets

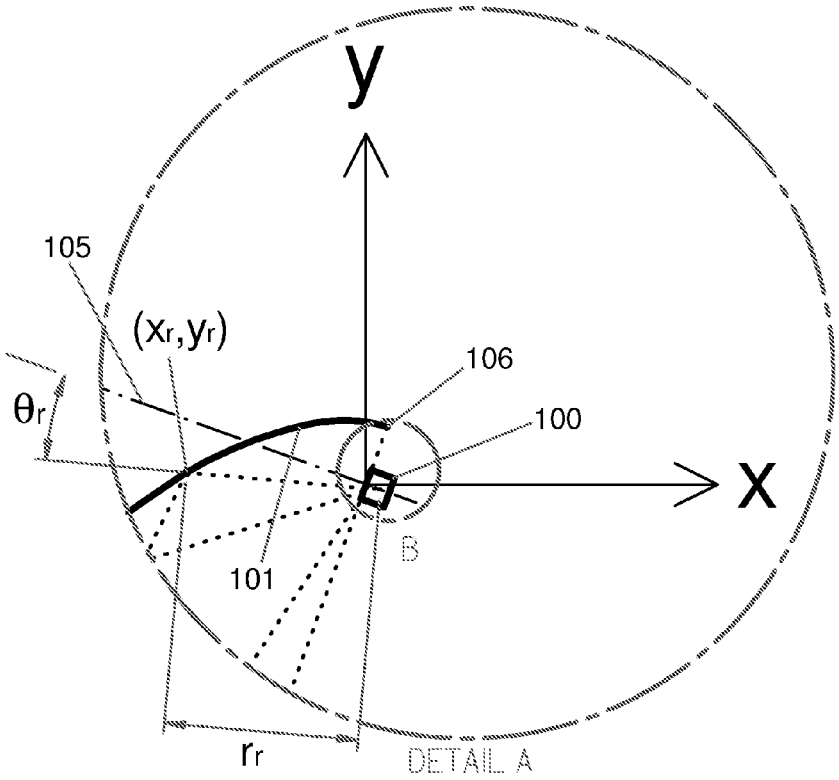
FIG. 1B
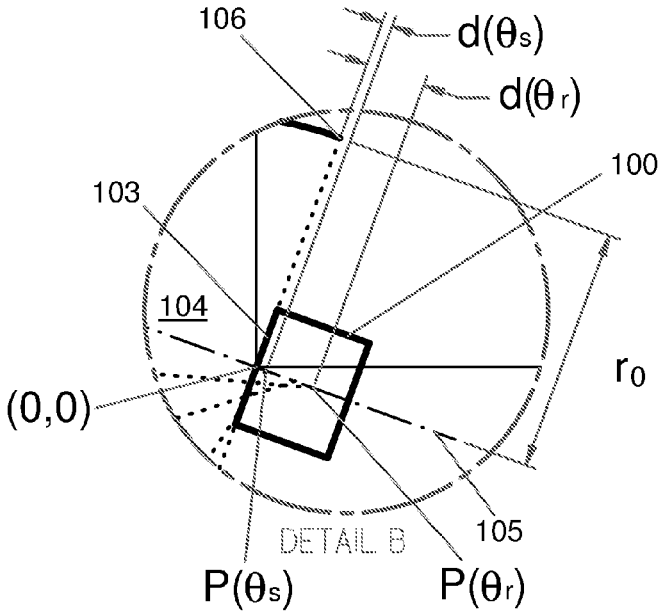
FIG. 1C
| x | y |
|---|---|
| 0.069 | 0.747 |
| -0.007 | 0.752 |
| -0.086 | 0.752 |
| -0.168 | 0.747 |
| -0.256 | 0.737 |
| -0.350 | 0.721 |
| -0.452 | 0.698 |
| -0.562 | 0.665 |
| -0.682 | 0.623 |
| -0.814 | 0.567 |
| -0.961 | 0.495 |
| -1.126 | 0.403 |
| -1.313 | 0.284 |
| -1.532 | 0.129 |
| -1.791 | -0.078 |
| -2.107 | -0.358 |
| -2.507 | -0.752 |
| -3.031 | -1.328 |
| -3.758 | -2.217 |
| -4.828 | -3.687 |
| -6.551 | -6.366 |
FIG. 2

LINEAR WASH LAMP

BACKGROUND

There exist multiple types of light sources currently in use for providing illumination. Such light sources are commonly referred to as lamps. Most of the lamps in use are electrically powered. One of the most common types in use is an incandescent lamp in which a filament of tungsten or other refractory material is heated by the power dissipated in the electrical resistance of the filament when an electrical current is forced through it. Much of the dissipated power is radiated as heat in the form of infrared radiation, some of the power converts to heat that leaves the lamp through thermal conduction and convection, and a relatively small portion of the power is radiated as visible light. For an incandescent lamp the power efficiency of the lamp, which is calculated as the ratio of the power radiated as visible light to the total electrical power dissipated in the lamp, is typically about 5 percent or lower.

The envelope of an incandescent lamp is capable of operating at high temperatures, and the portion of the dissipated power that is not radiated as heat or light is usually carried away almost entirely by convection. There usually is no need for an additional heat sink.

The light radiated from the filament of an incandescent lamp emerges in all directions, and any attempt to distribute the light efficiently and uniformly over a limited illuminated area in practice requires compound optics, such as a reflector in back of the envelope and either a reflector or a lens in front of it.

Another common type of lamp is a discharge lamp, in which electrical current flows through a gas. Excited by the current, the gas emits infrared, visible, and ultraviolet radiation. A fluorescent lamp is a type of discharge lamp in which much of the ultraviolet radiation is converted to visible radiation by a fluorescent coating. Other types of discharge lamps include sodium lamps, carbon arc lamps, mercury arc lamps, neon lamps, xenon lamps, plasma lamps, and metal halide lamps. Visible light is radiated with power efficiencies ranging up to the low twenty percent range. Much of the remaining power is dissipated as infrared or ultraviolet radiation, and some may be converted to heat that is carried away through thermal conduction and convection.

Discharge lamps share with incandescent lamps the ability to shed heat without the addition of a heat sink. Discharge lamps also share with incandescent lamps the need for compound optics to direct the light efficiently and uniformly over a limited illuminated area.

A newer category of light sources distinct from incandescent lamps and discharge lamps is that of solid-state light-emitting devices. Included in this category are, for example, electroluminescent devices, semiconductor lasers, and light-emitting diodes. Unlike incandescent lamps and discharge lamps, solid-state light-emitting devices suitable for illumination emit substantially all of their radiation in the form of visible light, and the amount of power emitted in the form of infrared or ultraviolet radiation is relatively insignificant. Currently, the most efficient of these solid-state light-emitting devices, the light-emitting diodes (LEDs) and the semiconductor lasers, may operate at power efficiencies as high as twenty to forty percent. The electrical power that is not converted to light is converted to heat. To be efficient and long-lasting the solid-state devices cannot operate at high temperatures. Due to the small sizes of practical high-power devices and the low temperatures at which they must operate, usually only a small fraction of the heat is removed from the devices directly through convection, and the remainder of the heat must be removed by thermal conduction through a heat sink that in turn spreads the heat and transfers the heat to the surrounding air by way of convection over a large surface area.

Also, unlike incandescent and discharge lamps, solid-state light-emitting devices emit light over a limited range of directions. Most, in fact, emit only into a half-space, since the devices are attached to heat sinks that would block any light emitted in other directions. This fact, coupled with the fact that solid-state light-emitting devices can be very small compared to incandescent and discharge sources, may present some unique opportunities.

There are many lighting applications in which a large, flat surface, often rectangular in shape, must be illuminated with some degree of uniformity. Examples include the illumination of billboard signs; illumination of displays, paintings, food service, etc.; illumination of walls for color or dramatic effect; and indirect lighting, in which walls or ceilings are illuminated so that they will act as non-glare sources of diffuse light. The usual practice is to use spotlights or floodlights for illumination or, in the case of indirect lighting, to hide the light source within a cove that keeps direct light from striking the eyes of viewers but allows direct and diffuse reflected light to strike a wall or ceiling. The illumination resulting from these methods is often lacking in either uniformity or efficiency. Meanwhile, methods for achieving more uniform illumination, such as the use of projection optics as in a movie projector or slide projector, are usually too expensive due to the cost of the optics. In addition, the use of projection optics often requires that the light source be inconveniently distant from the object being illuminated.

BRIEF SUMMARY

In some examples, a lamp assembly may include a light source, a specularly reflecting surface, and a heat sink. The light source may be in the configuration of an array of light-emitting devices disposed along a center line with all of the light-emitting devices oriented to emit light in the same primary direction. The specularly reflecting surface may be disposed in alignment with the light source, extending along the length of the light source and having a cross-section in planes perpendicular to the center line, which cross-section is constant over most of the length of the light source. The heat sink may have a mounting surface extending the length of the light source, and the light source may be mounted in thermal contact with the mounting surface. The light source may be such that essentially all of the light is emitted within a particular range of angles with respect to the primary direction of emission of the light-emitting devices, the angles being specified on a plane perpendicular to the center line. Light emitted over a first portion of this range of angles may be allowed to illuminate an object as direct light, while light emitted over the remaining, second portion of the range of angles may be intercepted by the specularly reflecting surface and be redirected, as reflected light, to the object. The design of the specularly reflecting surface may be such that the distribution of reflected light on the object may complement the distribution of direct light in a manner that may result in a distribution of total illumination on the object that is more uniform or otherwise more desirable than the distribution of illumination from direct light alone.

In some examples of the lamp assembly just described the specularly reflecting surface may be a portion of the surface of the heat sink. In other examples, the specularly reflecting surface may be a portion of a separate item aligned with the light source. In further examples, the heat sink may include a portion acting as a blind by intercepting light emitted over part of the first portion of the range of angles, thereby reducing the range of angles over which direct light may be distributed. In further examples, an end piece with a reflective surface may be attached to an end of the heat sink. In further examples, the heat sink may include an elongated hole passing through a curved exterior surface of the heat sink to facilitate the mounting of the lamp assembly to a surface with a range of orientations. In further examples, the specularly reflecting surface may be mottled, wrinkled, dimpled, faceted, or otherwise textured to produce a limited amount of diffusion or patterning of the reflected light.

BRIEF DESCRIPTION OF THE DRAWINGS

FIG. 1B is a detailed view of the geometry included in circle A in FIG. 1A.

FIG. 1C is a detailed view of the geometry included in circle B in FIG. 1B.

FIG. 2 is a table of x and y coordinate values of points on the reflecting surface shown in FIGS. 1A, 1B, and 1C.

DETAILED DESCRIPTION OF VARIOUS EMBODIMENTS

A linear wash lamp disclosed in the present application will become better understood through review of the following detailed description in conjunction with the drawings. The detailed description and drawings provide examples of the various embodiments described herein. Those skilled in the art will understand that the disclosed examples may be varied, modified, and altered without departing from the scope of the disclosed structures. Many variations are contemplated for different applications and design considerations; however, for the sake of brevity, not every contemplated variation is individually described in the following detailed description.

An embodiment of a linear wash lamp is now described in more detail with reference to FIGS. 1A-6B. In the various figures, like or similar features have the same reference labels. All views described as "end view," "front view," or "bottom view" show objects as viewed from a particular direction with objects oriented as they would be in an overall assembly shown in FIG. 5A, 5B, or 5C respectively. Descriptors such as "end," "front," or "bottom" are relative references that aid in the description and are not intended to indicate a particular position or orientation. In discussions of angles the angle measures are stated in units of radians unless otherwise indicated.

Figure 1A:
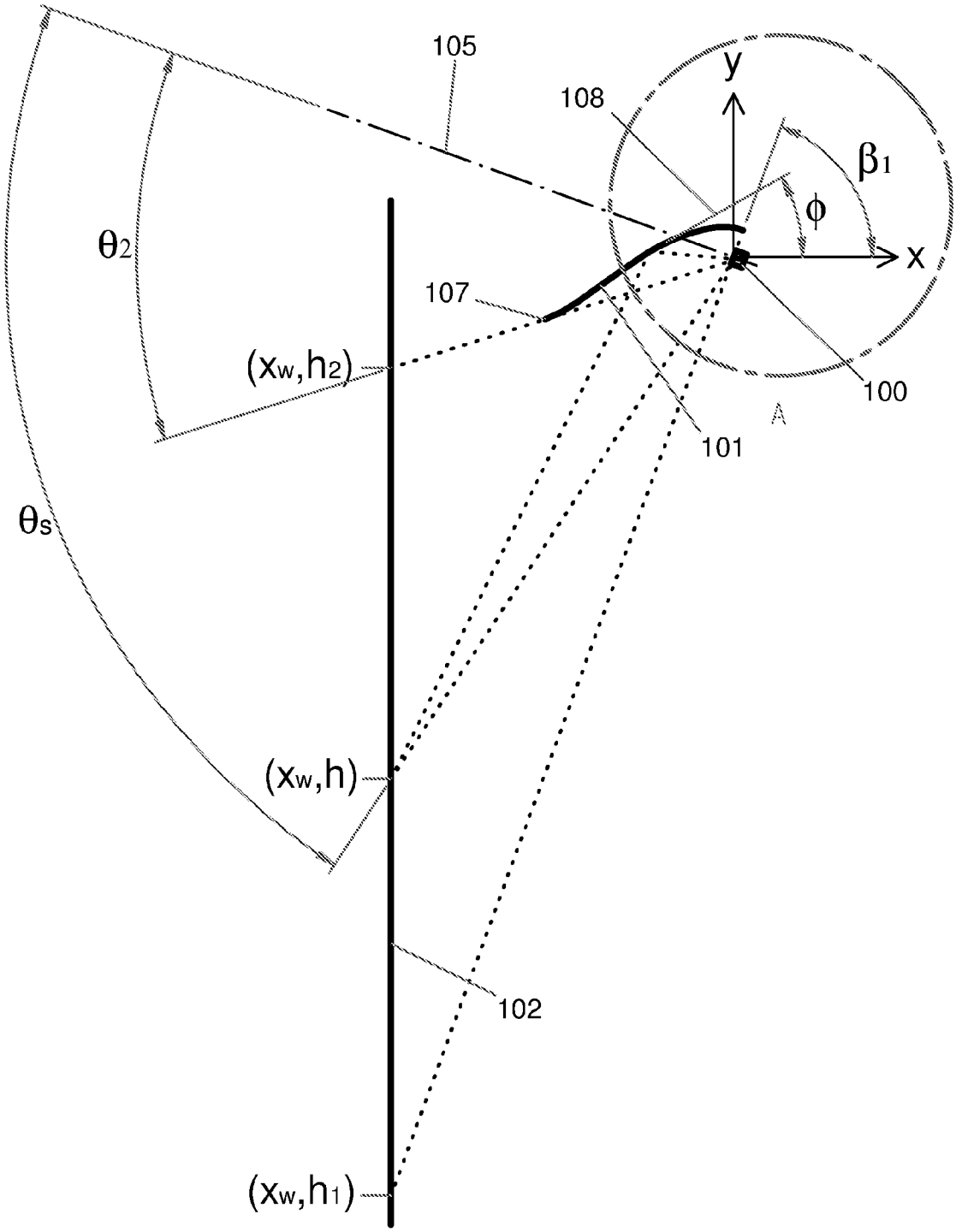
FIG. 1A is a drawing showing the two-dimensional cross-sectional geometry, in one embodiment of the current invention, of the reflecting surface in relationship to a light source and a flat surface to be illuminated.

FIG. 1A and the detail views in FIGS. 1B and 1C illustrate in cross-section the geometry of a linear light-emitting array 100, a reflecting surface 101, and a flat surface 102. All three of these objects may extend by arbitrary distances into the z direction perpendicular to the plane of the cross-section. If the distances in the z direction over which the components of the lamp extend are large in comparison with the sizes of the cross-sections of the components and the portion of the flat surface 102 to be illuminated, and if the intensity and pattern of light emission of the linear light-emitting array 100 are approximately uniform along the z direction, then the problem of determining the distribution of illumination on the flat surface 102 becomes a two-dimensional problem in the dimension space indicated by directions x and y in FIGS. 1A and 1B.

For the present embodiment, with reference to FIGS. 1A, 1B, and 1C it may be assumed that linear light-emitting array 100 has a front surface 103 that is substantially planar, and it may be assumed that light is emitted only into the half-space 104 bounded by the plane of front surface 103. It may be assumed that the flux of light from linear light-emitting array 100 is a function $I(\theta)$ of the angle $\theta$, with respect to the normal 105 to front surface 103, of the direction in which the light is emitted. It may also be assumed that the light emitted at an angle $\theta$ appears to emanate from a virtual source position $P(\theta)$ on normal 105 to front surface 103 at a distance $d(\theta)$ behind front surface 103. Indicated in FIG. 1C are the virtual source positions $P(\theta_r)$ and $P(\theta_s)$ and the distances $d(\theta_r)$ and $d(\theta_s)$ corresponding to angles $\theta_r$ and $\theta_s$ respectively.

Reflecting surface 101 has a near edge 106 closest to linear light-emitting array 100 and a far edge 107 farthest from linear light-emitting array 100. Light from linear light-emitting array 100 emitted at angle $\theta=-\pi/2$, expressed in radians, may strike reflecting surface 101 at its near edge 106. Light emitted at angle $\theta_2$ may strike reflecting surface 101 at its far edge 107. All light emitted at angles $\theta$ between $-\pi/2$ and $\theta_2$ may strike reflecting surface 101. All light emitted at angles $\theta$ between $\theta_2$ and $\pi/2$ may strike flat surface 102 directly. Let the origin (0,0) of the Cartesian coordinate system defined by directions x and y be located at the intersection of front surface 103 and normal 105. Let flat surface 102 be at the plane defined by $x=x_w$. Let $h_1$ be the y coordinate at a position $(x_w,h_1)$ below which no direct light is to strike flat surface 102. To assure that no direct light may strike flat surface 102 at positions below $(x_w,h_1)$, linear light-emitting array 100 may be oriented in such a way that direct light striking flat surface 102 at position $(x_w,h_1)$ is emitted at angle $\theta=\pi/2$ with respect to the normal 105 to front surface 103, while direct light striking flat surface 102 at positions above $(x_w,h_1)$ is emitted at angles $\theta<\pi/2$. Let $h_2$ be the y coordinate at a position $(x_w,h_2)$ above which no direct light is to strike flat surface 102. The latter condition is assured if light striking position $(x_w,h_2)$ directly from linear light-emitting array 100 is emitted at angle $\theta=\theta_2$, since any light emitted at angles $\theta$ between $-\pi/2$ and $\theta_2$ will be prevented by reflecting surface 101 from striking flat surface 102 directly.

An arbitrary point $(x_w,h)$ on flat surface 102 with h between $h_1$ and $h_2$, is illuminated directly by light emitted from light-emitting array 100 at angle $\theta_s$ to normal 105 as shown in FIG. 1A. The illumination at point $(x_w,h)$ may be supplemented with additional illumination from light emitted by light-emitting array 100 at some angle $\theta_r$ between $-\pi/2$ and $\theta_2$ indicated in FIG. 1B, providing reflecting surface 101 is specular and the angle $\phi$ of the tangent 108 of reflecting surface 101 at the point at which the light strikes reflecting surface 101 is adjusted to reflect the light toward point $(x_w,h)$.

Conceivably, for every emission angle $\theta_r$ between $-\pi/2$ and $\theta_2$ the angle $\phi$ at the point at which the light strikes reflecting surface 101 can be adjusted to direct the reflected light toward point $(x_w,h)$. In fact, as is commonly known to those skilled in the art of optics, all of the light emitted at angles $\theta_r$ between $-\pi/2$ and $\theta_2$ may be reflected toward point $(x_w,h)$ by a reflecting surface 101 approximating the shape of an ellipse with foci at (0,0) and $(x_w,h)$, provided the corresponding distances $d(\theta_r)$ are small relative to $r_0$ in FIG. 1C. If reflecting surface 101 has a specular reflectance $\rho$, then, the total light flux reflected by reflecting surface 101 is diminished by the factor $\rho$. Examining an opposite extreme, for every emission angle $\theta_r$ between $-\pi/2$ and $\theta_2$ the angle $\phi$ at the point at which the light strikes reflecting surface 101 can be adjusted to direct the reflected light toward points other than $(x_w,h)$. In this case, none of the light emitted at angles $\theta_r$ between $-\pi/2$ and $\theta_2$ will be reflected toward point $(x_w,h)$. It is also possible to set angles $\phi$ on a portion of reflecting surface 101 to reflect light toward point $(x_w,h)$ while setting angles $\phi$ on other portions of reflecting surface 101 to reflect light toward points other than $(x_w,h)$, and, therefore, any amount of light between zero and the total light flux reflected by reflecting surface 101 diminished by the factor $\phi$ may be directed toward point $(x_w,h)$. Since the same is true for any other points $(x_w,h')$ with h' between $h_1$ and $h_2$, it is clear that there is a considerable amount of flexibility in the way the light reflected by reflecting surface 101 may be distributed over flat surface 102. In fact, any desired distribution of the reflected light may be achieved through a proper shaping of reflecting surface 101.

In an embodiment of the linear wash lamp, reflecting surface 101 may be shaped to distribute the reflected light in such a way that the reflected light complements the direct light in order to produce an overall illumination intensity on flat surface 102 that varies linearly from zero at point $(x_w,h_1)$ to a maximum value at point $(x_w,h_2)$. At the near edge 106 of reflecting surface 101 the tangent to reflecting surface 101 may be perpendicular to the plane of front surface 103 so that light emitted at angle $-\pi/2$ with respect to normal 105 will be reflected toward point $(x_w,h_1)$ on flat surface 102. Progressing from near edge 106 toward far edge 107 the reflecting surface 101 may be curved initially to reflect some light toward points in the vicinity of point $(x_w,h_1)$, in which case the curve may approximate an ellipse with one focus at point $(d(\theta)(\cos(\beta_1+\pi/2+\theta), d(\theta)\sin(\beta_1+\pi/2+\theta))$, which is the position of the virtual source, and the other focus at point $(x_w,h_1)$, where $\beta_1$ is the angle of front surface 103 with respect to the x axis, as shown in FIG. 1A, and $\theta=-\pi/2$ is the angle of emission for light striking near edge 106. Progressing further from near edge 106 the curvature may be altered to approximate an ellipse with foci at $(d(\theta)(\cos(\beta_1+\pi/2+\theta), d(\theta)\sin(\beta_1+\pi/2+\theta))$ and $(x_w,h)$, where h is a step closer to $h_2$ and $\theta$ is incrementally greater than $-\pi/2$. This portion of reflecting surface 101 will reflect light toward the vicinity of point $(x_w,h)$. Progressing yet further from near edge 106, once enough light has been reflected to the vicinity of point $(x_w,h)$, the curvature of reflecting surface 101 may be set to reflect light to a point $(x_w,h)$ with h another step closer to $h_2$. This procedure may be repeated iteratively until the far edge 107 of reflecting surface 101 has been reached, at which point the reflected light may be directed toward point $(x_w,h_2)$. This iterative procedure may result in a reflecting surface 101 in the form of a continuous curve as shown in FIG. 1A.

In practice, as is known by persons skilled in the art of geometry, the iteration may be performed mathematically if the flux distribution function $I(\theta)$ is known for all light emission angles $\theta$. Alternatively, the curvature of reflecting surface 101 may be adjusted manually through trial and error to achieve the required distribution of reflected light.

The table in FIG. 2 gives the x and y coordinates of twenty-one points on reflecting surface 101. The coordinates are the result of an iterative computation for the embodiment specified in the remainder of this paragraph. In this embodiment the values of $x_w$, $h_1$, and $h_2$ are −7 inches, −76 inches, and −6.86 inches respectively. The flux distribution function $I(\theta)$ over emission angle $\theta$ is Lambertian with the maximum at angle $\theta=0$. The light is sourced by a light-emitting device of insignificant size located 0.125 inches from front surface 103 toward the interior of linear light-emitting array 100 along normal 105. The space between the plane of front surface 103 and the light-emitting device is filled with a transparent material with an isotropic index of refraction equal to 1.42, and the space on the other side of the plane of front surface 103 is filled with air. The distance $d(\theta)$ of the virtual source from the plane of front surface 103 as a function of angle $\theta$ is calculated with the use of Snell's law. The reflectance $\rho$ of reflecting surface 101 is assumed to be 0.8, and the reflection is assumed to be entirely specular. The desired illumination intensity distribution on flat surface 102 as a function of y coordinate h ranges linearly from zero at $h=h_1$ to a maximum value at $h=h_2$ and is zero everywhere outside this range. When reflecting surface 101 is formed as a smooth curve through the twenty-one points specified by the table in FIG. 2, the desired intensity distribution may be achieved.

Figure 3A:
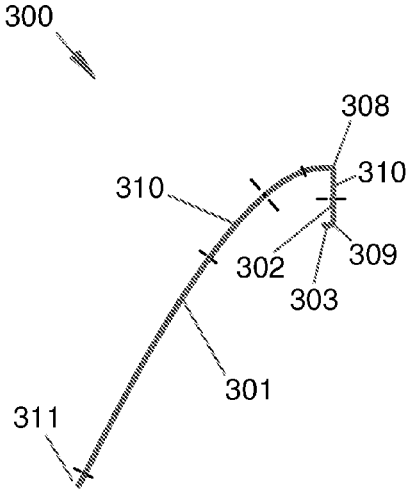
FIG. 3A is an end view of a heat sink including a specularly reflecting surface having the geometry shown in FIGS. 1A, 1B, 1C, and 2.
Figure 3B:
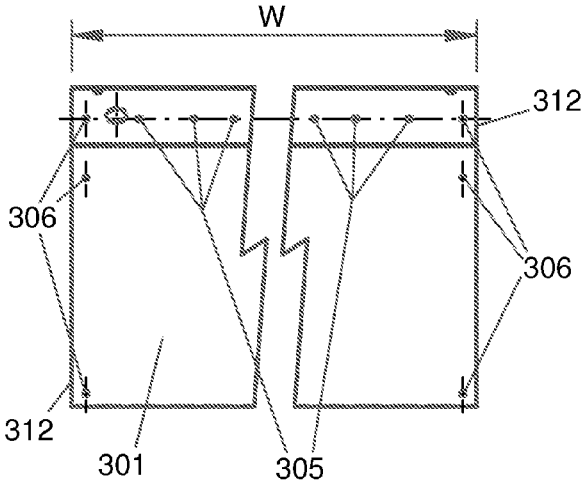
FIG. 3B is a front view of the heat sink of FIG. 3A.
Figure 3C:
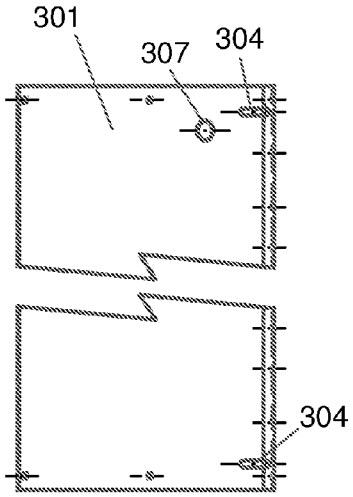
FIG. 3C is a bottom view of the heat sink of FIGS. 3A and 3B.

FIGS. 3A, 3B, and 3C are drawings of an end view, a front view, and a bottom view respectively of a heat-sinking reflector 300 designed in such a way that specularly reflecting surface 301 may conform to the calculated coordinates from the table in FIG. 2. In addition to specularly reflecting surface 301, heat-sinking reflector 300 includes a mounting surface 302, a blind 303, oblong mounting holes 304, heat sink mounting holes 305, end piece mounting holes 306, and one or more exit holes 307

In a preferred embodiment heat-sinking reflector 300 may be formed from aluminum lighting sheet with high specular reflectance, preferably above 80%, on at least one surface. A preferred thickness of the aluminum lighting sheet may be 0.040 inches. The sheet may be shaped by various rolling or bending processes so that a surface with high specular reflectance forms specularly reflecting surface 301. A 90-degree first bend 308 may produce mounting surface 302, which is substantially flat, and a 90-degree second bend 309 may produce blind 303. The outer surface 310 of heat-sinking reflector 300 may have any finish, such as, for example, a wire-brushed finish, a polished finish, a bright-dipped finish, an anodized finish, a powder-coated finish, or a painted finish. In a preferred embodiment the width W of heat-sinking reflector 300 may be approximately 24 inches, but other widths are allowed without limitation. Lamps incorporating this type of heat-sinking reflector may be placed end-to-end to produce the effect of one lamp of length many times W.

Heat-sinking reflector 300 may also be formed from other materials that may or may not have high specular reflectance on a surface. An overlay, inlay, coating, or insert of material with high specular reflectance may be attached to or pressed against heat-sinking reflector 300 to create specularly reflecting surface 301. Heat-sinking reflector 300 may have holes other than those shown in FIGS. 3A, 3B, and 3C or may have slots, louvers, or perforations for various purposes including ventilation. Heat-sinking reflector 300 may also have additional bends to add further strength, such as a bend at far edge 311. Bends 308 and 309 may be at angles other than 90 degrees, and second bend 309 and blind 303 may be omitted, or second bend 309 can be at any angle in the opposite direction. Mounting surface 302 and/or blind 303 may extend farther away from first bend 308 than shown in order, for example, to sink more heat, to increase the rate of convective heat transfer to the surrounding air, to hide portions of the lamp from view, or to change the appearance or styling of the lamp. There may be more or fewer oblong mounting holes 304, heat sink mounting holes 305, and/or end piece mounting holes 306 than are shown in FIGS. 3A, 3B, and 3C, and these holes may have shapes other than circular or oblong. End piece mounting holes 306 may extend to the curved edges 312 of heat-sinking reflector 300 and become open at the ends. End piece mounting holes 306 may be omitted and/or replaced with deformations such as, for example, catches, dimples, louvers, or hooks.

Figure 4A:
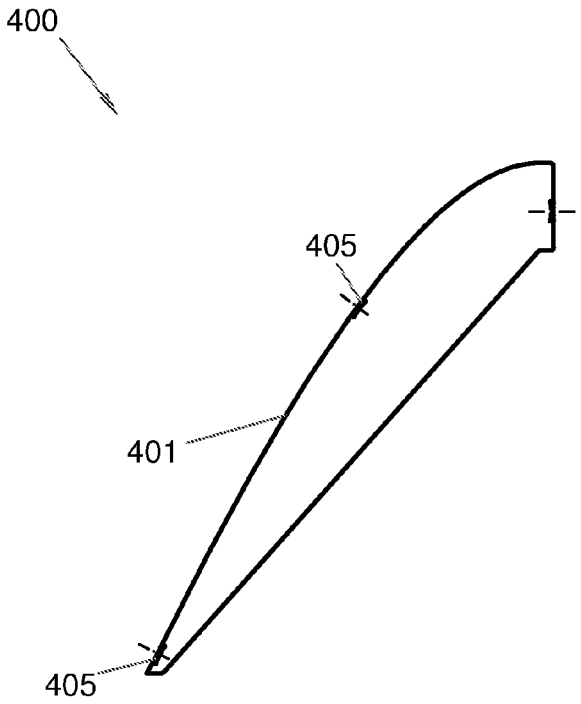
FIG. 4A is an end view of an end piece.
Figure 4B:
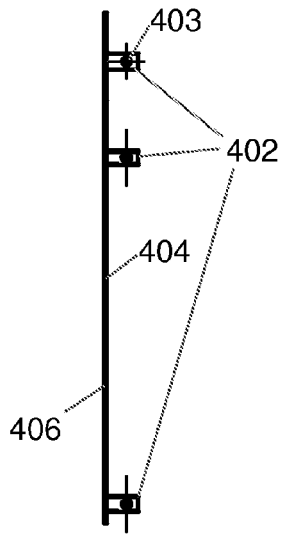
FIG. 4B is a front view of the end piece of FIG. 4A.
Figure 4C:
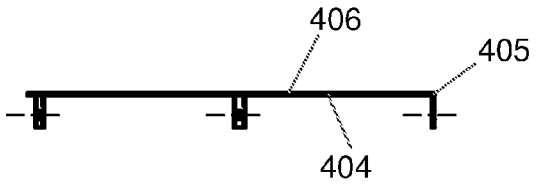
FIG. 4C is a bottom view of the end piece of FIGS. 4A and 4B.

FIGS. 4A, 4B, and 4C are drawings of an end view, a front view, and a bottom view respectively of an end piece 400. End piece 400 may have an edge 401 a portion or portions of which may conform to the calculated coordinates from the table in FIG. 2. End piece 400 may include mounting tabs 402, and mounting tabs 402 may include fastening holes 403. The inner surface 404 of end piece 400 may be specularly reflective.

In a preferred embodiment, end piece 400 may be formed from aluminum lighting sheet with high specular reflectance, preferably above 80%, on at least one surface. A preferred thickness of the aluminum lighting sheet may be 0.040 inches. Mounting tabs 402 may be formed by way of tab bends 405. The outer surface 406 of end piece 400 may have any finish, such as, for example, a wire-brushed finish, a polished finish, a bright-dipped finish, an anodized finish, a powder-coated finish, or a painted finish.

End piece 400 may also be formed from other materials that may or may not have high specular reflectance on a surface. An overlay, inlay, coating, or insert of material with high specular reflectance may be attached to or pressed against inner surface 404 to create a surface with desired optical reflectance properties such as, for example, specular reflectance or diffuse reflectance with high total reflectivity. End piece 400 may have holes other than those shown in FIGS. 4A, 4B, and 4C or may have slots, louvers, or perforations for various purposes including ventilation. End piece 400 may also have additional bends to add further strength. Tab bends 405 may be at angles other than 90 degrees, and one or more tab bends 405 may be at angles in directions opposite to those shown so that the corresponding tabs protrude to the side of inner surface 404 opposite to that shown. Inner surface 404 may be flat or may have curvature. Fastening holes 403 may be round as shown in FIGS. 4B and 4C or may have other shapes, such as, for example, oblong, square, or rectangular. Fastening holes 403 may be closed as shown or may be open at one end or over a portion of the hole periphery. Fastening holes 403 may be omitted. Mounting tabs 402 may be configured or deformed to produce, for example, dimples, catches, or barbs. There may be more or fewer mounting tabs 402 than are shown in FIGS. 4A, 4B, and 4C. One or more mounting tabs 402 may be extended along edge 401 to form continuous flanges, and each such extended tab may have more than one fastening hole 403.

Figure 5A:
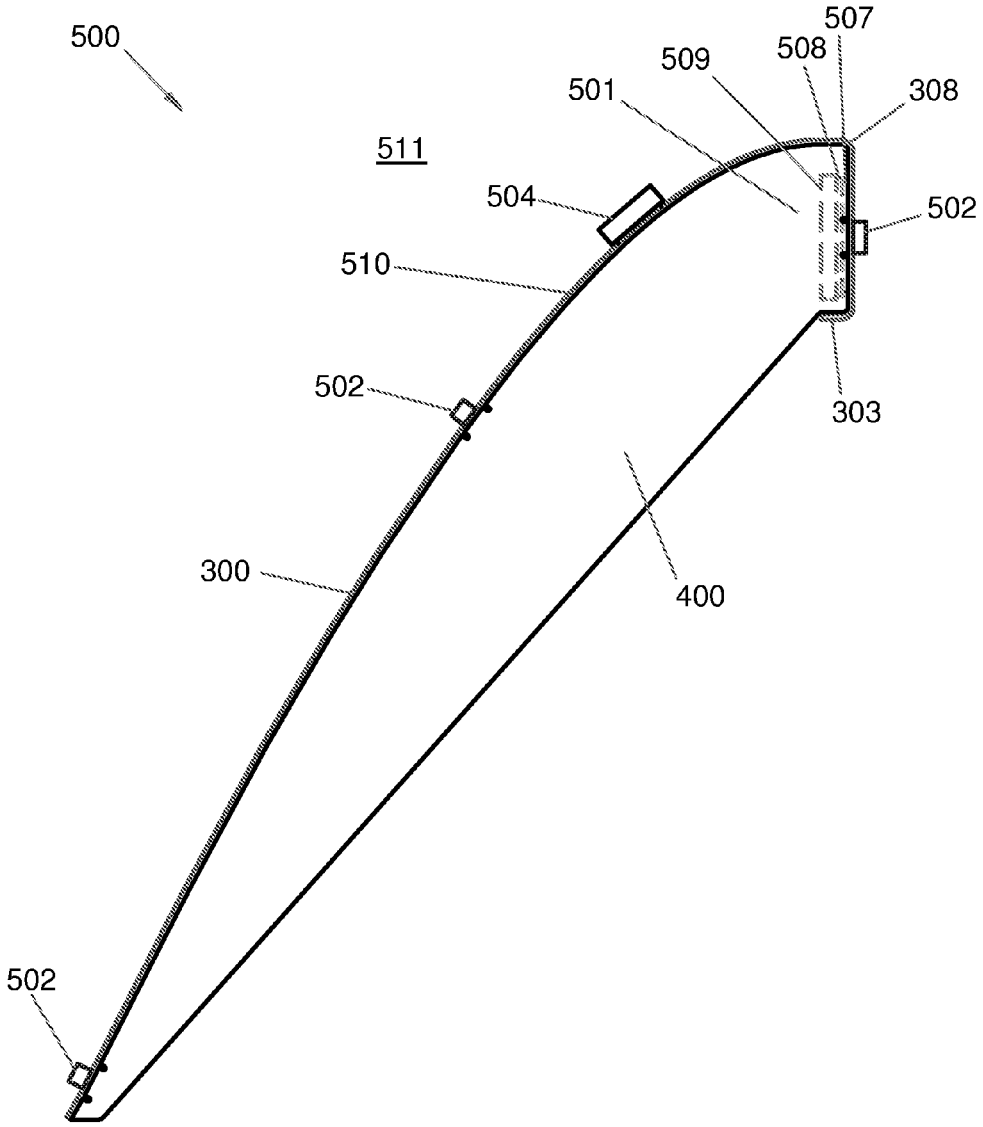
FIG. 5A is an end view of a lamp assembly.
Figure 5B:
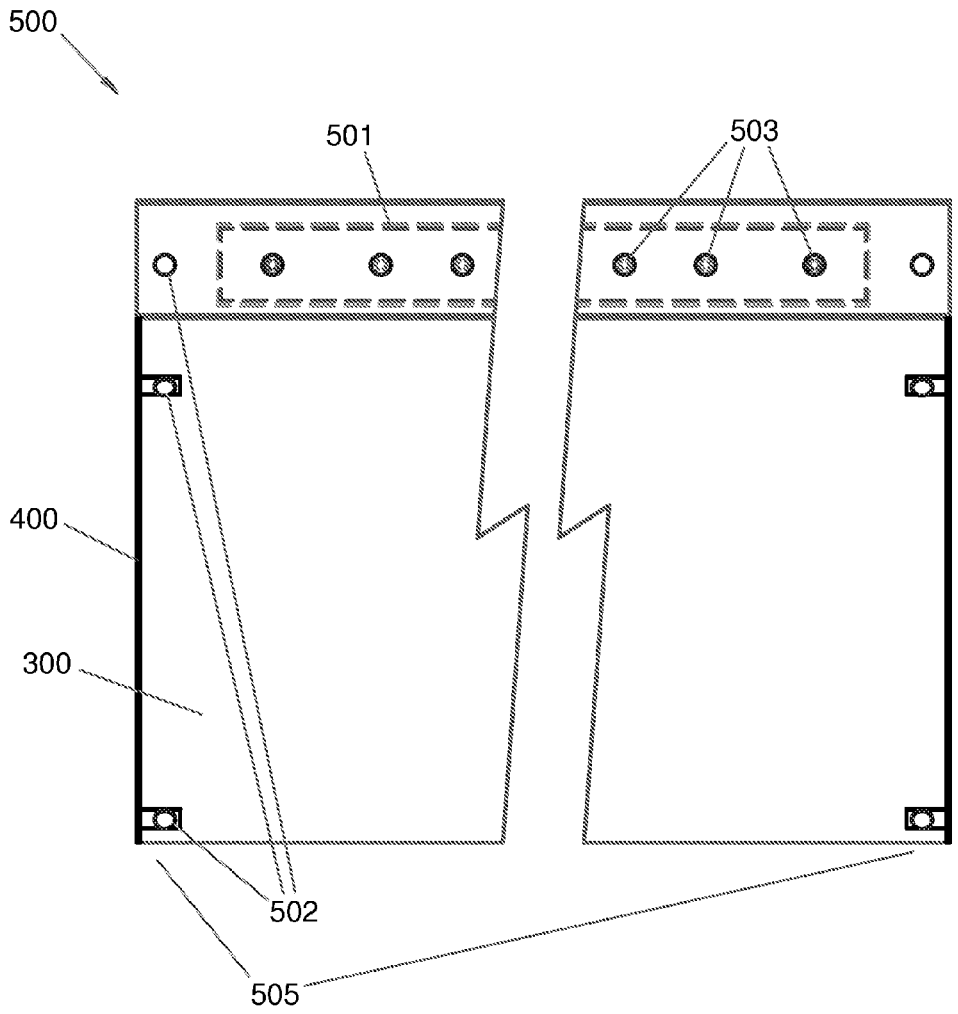
FIG. 5B is a front view of the lamp assembly of FIG. 5A.
Figure 5C:
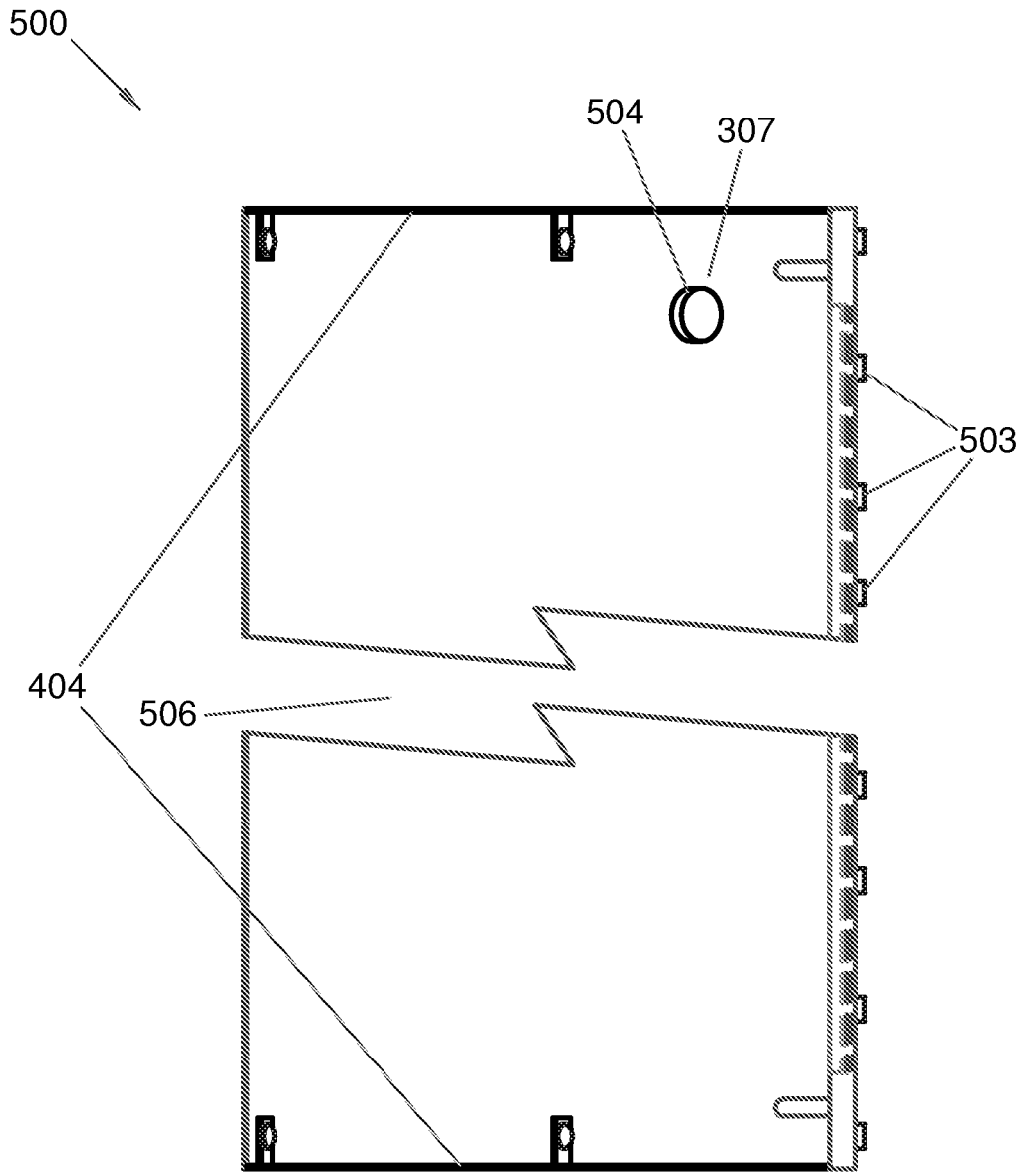
FIG. 5C is a bottom view of the lamp assembly of FIGS. 5A and 5B.

FIGS. 5A, 5B, and 5C are drawings of an end view, a front view, and a bottom view respectively of a lamp assembly 500. Included in lamp assembly 500 may be a heat-sinking reflector 300, one or more end pieces 400, and a light source 501. Also included may be end piece fasteners 502 and/or light source fasteners 503. End piece fasteners 502 and/or light source fasteners 503 may be rivets, screws, or other fastener types suitable for applying compression between two joined elements and may include lock washers, springs, or other devices to enhance the performance or reliability of the fasteners. Also included may be one or more wire- or cable-protecting devices 504 each attached to an exit hole 307, and each wire- or cable-protecting device 504 may include, for example, a grommet, a strain relief, a cable sheath, a cable clamp, or other type of device that may protect a wire or cable from insulator abrasion and/or conductor breakage and/or that may anchor a wire or cable so that the wire or cable may resist movement or damage under tension.

In a preferred embodiment one end piece 400 may be attached to heat-sinking reflector 300 at each end 505 of lamp assembly 500. Each end piece 400 may have a specularly reflective inner surface 404 on the side facing toward the inside 506 of lamp assembly 500. The end piece fasteners 502 and light source fasteners 503 may be pop rivets. A single wire- or cable-protecting device 504 may consist of a strain relief bushing. Light source 501 may include a circuit board assembly 507, a gasket 508, and a bezel 509 similar to those disclosed in Patent Application Number PCT/US2010/045236 filed with the U.S. Patent and Trade Office on Aug. 11, 2010. Light source 501 may also include a potting compound as described in the above application. Light source 501 may also include wires connected as described in the above application. The wires (not shown in FIG. 5) may be fed through wire- or cable-protecting device 504 so that they may emerge from the back 510 of lamp assembly 500.

In other embodiments of lamp assembly 500 there may be no end pieces 400, or there may be more than two end pieces 400, and one or more end pieces may be placed within the inside 506 of lamp assembly 500 rather than at an end 505. End pieces 400 may be specularly reflective on both sides. One or more end pieces 400 may be attached to heat-sinking reflector 300 with attachment means other than rivets, such as, for example, screws, spot welds, bends, catches, dimples, or mechanical resistance. One or more of light source fasteners 503 may be screws or other fastener types suitable for applying compression between joined elements and may include lock washers, springs, or other devices to enhance the performance or reliability of the fasteners. Light source fasteners 503 may be omitted. Light source 501 may be held in place by pressure from a portion of blind 303 and another feature of heat-sinking reflector 300, and additional bends or features in heat-sinking reflector 300 may be present to facilitate such capture. Wire- or cable-protecting device 504 may be omitted, or there may be more than one wire- or cable-protecting device 504, and each wire- or cable-protecting device 504 may be something other than a strain-relief bushing, such as, for example, a grommet, a cable sheath, or a cable clamp. Wire- or cable-protecting device 504 may be a connector, such as, for example, a panel-mount connector, to which wires from light source 501 may be attached to make electrical connection from the inside 506 and to which a plug or receptacle may be electrically and mechanically connected from the outside 511 of lamp assembly 500. There may be no exit holes 307 in heat-sinking reflector 300. There may be one or more exit holes in each of one or more end pieces 400, and each such exit hole may have attached to it a wire- or cable-protecting device 504. The light-emitting devices within light source 501 may be light-emitting diodes, incandescent lamps, arc lamps, plasma light emitters, or any other kind of light-emitting device small in size in comparison to the distance between the light-emitting devices and first bend 308.

Figure 6A:
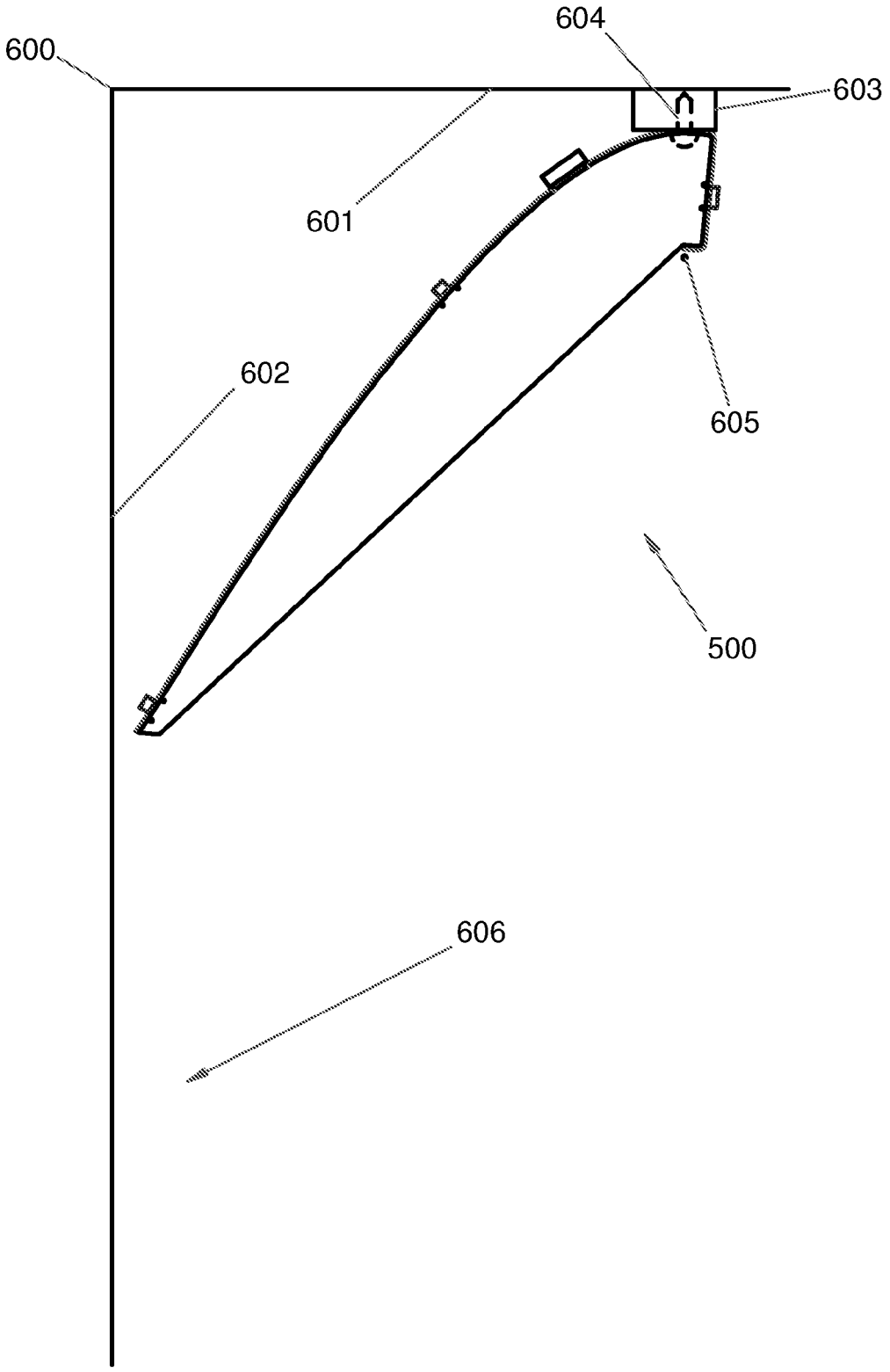
FIG. 6A is an end view of a wash lamp assembly mounted to a ceiling and oriented to wash a wall with illumination linearly tapered in intensity.
Figure 6B:
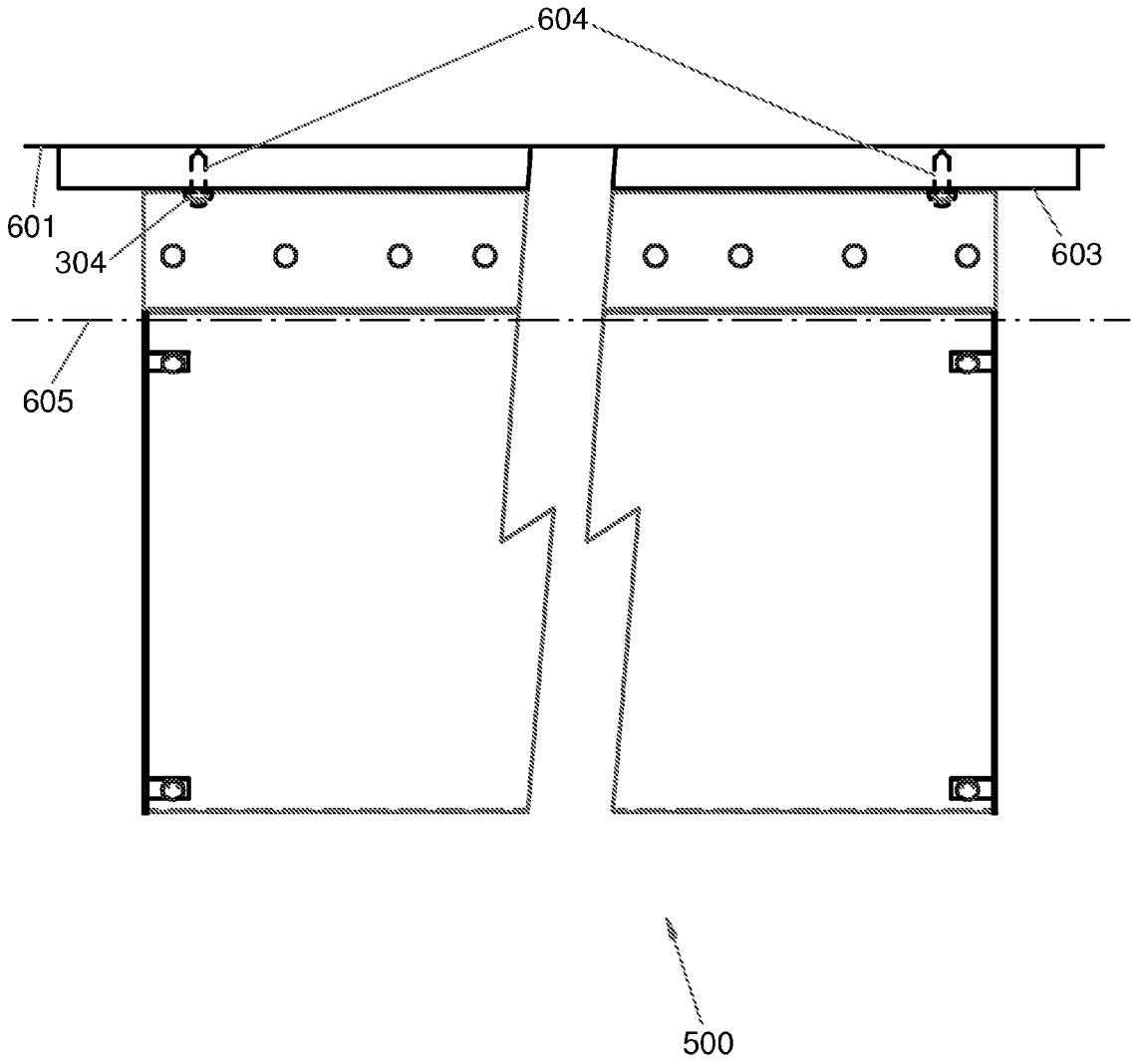
FIG. 6B is a front view of the wash lamp assembly of FIG. 6A.

FIGS. 6A and 6B are drawings of an end view and a front view respectively showing how lamp assembly 500 might be mounted near the corner 600 between a first and second intersecting flat surfaces 601 and 602 respectively, one of which may be a wall, for example, and the other a ceiling, for example, or a floor or ledge. If necessary, a rail 603 may be mounted to first flat surface 601. Lamp assembly 500 may be secured to rail 603 with one or more lamp fasteners 604 each of which passes through an oblong mounting hole 304 and into rail 603 and/or first flat surface 601. If lamp fasteners 604 are not tightened against lamp assembly 500, lamp assembly 500 may be adjusted rotationally about a long axis 605, as permitted by an oblong nature of oblong mounting holes 304 in order to align the illumination pattern 606 on second flat surface 602 as desired. With lamp assembly 500 positioned to the desired rotational orientation, lamp fasteners 604 may be tightened to hold lamp assembly 500 in the desired orientation securely to rail 603 or, if rail 603 is omitted, to first flat surface 601. Rail 603 may consist of wood, plastic, metal, or any other material that supplies structural support and is capable of accepting lamp fasteners 604. Lamp fasteners 604 may be, for example, wood screws, machine screws that may be accompanied by nuts and/or washers and/or springs, rivets, nails, or other suitable fastening devices.

It will be appreciated that heat-sinking reflector 300 can be a special case of the heat sink (600) described in Patent Application Number PCT/US2010/045236 filed with the U.S. Patent and Trade Office on Aug. 11, 2010, and that heat-sinking reflector 300 may function in a similar manner to conduct and dissipate heat generated by light source 501 while supplying mechanical support for light source 501.

In some cases—if lighting sheet of sufficient thickness is not available, for example—it may be desirable for heat sinking purposes to have a separate piece of sheet material overlapping mounting surface 302 to bring the thickness of the combined sheets to a total that is conducive to sufficient lateral heat transfer. A blind 303 and/or a reverse bend may be incorporated into this piece, and additional heat sink mounting holes axially coincident with heat sink mounting holes 305 may be incorporated into this piece. Light source fasteners 503 may pass through the additional heat sink mounting holes on this piece as well as the heat sink mounting holes 305 in heat-sinking reflector 300 and corresponding holes in light source 501.

It may also be noted that reflecting surface 101 may be designed such that light emitted by linear light-emitting array 100 at certain angles $\theta_r$ may be directed to positions $(x_w,h)$ by portions of reflecting surface 101 other than those contemplated previously. For example, the preferred embodiments so far described have light emitted at angle $\theta_r=-\pi/2$ striking reflecting surface 101 at near edge 106 and being reflected toward position $(x_w,h_1)$, while light emitted at angle $\theta_r=\theta_2$ strikes reflecting surface 101 at far edge 107 and is reflected toward position $(x_w,h_2)$. This arrangement helps to keep the angle of incidence of the light on flat surface 102 relatively constant over the illuminated area between position $(x_w,h_1)$ and position $(x_w,h_2)$. However, it is also possible to design reflecting surface 101 so that light emitted at angle $\theta_r=-\pi/2$ striking reflecting surface 101 at near edge 106 is reflected toward position $(x_w,h_2)$, while light emitted at angle $\theta_r=\theta_2$ strikes reflecting surface 101 at far edge 107 and is reflected toward position $(x_w,h_1)$. It is also possible to design reflecting surface 101 with a plurality of facets, rather than a continuous curve, in such a way that each facet may reflect light toward a particular approximate position $(x_w,h)$ and the total effect of all of the facets may produce approximately the desired illuminance distribution of reflected light.

Although the preferred embodiments that have been described above assume a light source 501 that emits light solely within half-space 104 and hence at angles $\theta$ to normal 105 between $-\pi/2$ and $\pi/2$, it will be clear to persons skilled in the art that endpoint angles differing from $-\pi/2$ and $\pi/2$ may be accommodated with an approach similar to the approach that has been described.

In more general terms, a linear wash lamp may comprise: a light source the rays of light from which emanate from the vicinity of a center line, the vicinity being defined as points located less than a maximum source radius from the center line, and which rays radiate predominantly into a sector of space having the center line as its vertex, a first plane that contains the center line defining a first boundary of the sector, and a second plane that contains the center line defining a second boundary of the sector, the sector being characterized by an included angle that is the angle traversing the sector between the first plane and the second plane; and a reflecting surface disposed a distance greater than the maximum source radius from the center line, the cross-section of which reflecting surface is substantially constant in size, shape, and orientation in all planes perpendicular to the center line that intersect the light source, the reflecting surface exhibiting primarily specular reflectance of light, the reflecting surface extending to intercept light emitted at angles between the angle of the first plane bounding the sector and the angle of a cutoff plane within the sector, which cutoff plane contains the center line, the reflecting surface not intercepting light at angles between the cutoff plane and the angle of the second plane bounding the sector, the shape of the reflecting surface being such that light reflected by the reflecting surface adds, on an object surface, illumination that supplements the direct illumination by light not intercepted by the reflecting surface.

In further examples of this linear wash lamp, the shape of the reflecting surface may be such that the total illumination on a flat object surface in a plane parallel to the center line, which illumination is a combination of direct illumination by light not intercepted by the reflecting surface and the supplementary illumination by light reflected by the reflecting surface, is uniform between the second plane and the cutoff plane, provided the extent of the light source along the direction of the center line is much greater than the greatest distance from the center line to the illuminated portion of the object surface. Alternatively, the shape of the reflecting surface may be such that the total illumination on a flat object surface in a plane parallel to the center line, which illumination is a combination of direct illumination by light not intercepted by the reflecting surface and the supplementary illumination by light reflected by the reflecting surface, varies linearly with distance along a line on the object surface between the second plane and the cutoff plane, provided the extent of the light source along the direction of the center line is much greater than the greatest distance from the center line to the illuminated portion of the object surface.

In further examples, the linear wash lamp may further comprise a heat sink having a mounting surface to which the light source can be attached and through which heat can flow from the light source into the heat sink.

In further examples, this linear wash lamp with heat sink may further comprise an end piece attached to an end of the heat sink and having a surface substantially perpendicular to the center line, which surface faces toward the other end of the heat sink and which surface is either specularly or diffusively reflective.

In further examples, the linear wash lamp with heat sink may further comprise an elongated hole penetrating through a portion of the heat sink having a curved outer surface, the direction of penetration and the direction of elongation both being in a plane perpendicular to the center line.

In further examples, the linear wash lamp with heat sink may further comprise a portion of the heat sink that may function as a blind by intercepting light emitted by the light source into a portion of the sector between the second boundary and a blind edge plane containing the center line and traversing the interior of the portion of the sector between the second boundary and the cutoff plane.

In further examples of the linear wash lamp with or without heat sink, the intersection of the reflecting surface with a plane perpendicular to the center line may follow a continuous curve.

In further examples of the linear wash lamp with or without heat sink, the reflecting surface may be mottled, wrinkled, dimpled, faceted, or otherwise textured sufficiently to produce a limited amount of diffusion or patterning of the reflected light.

In further examples of the linear wash lamp with or without heat sink, the light source may radiate into a half-space, the included angle of the sector being approximately 180 degrees, and the intersection of the reflecting surface with a plane perpendicular to the center line may have a tangent at a first point at which the intersection meets the first boundary of the sector, the tangent being perpendicular to the first plane and the first point being, of all points on the intersection, the one closest to the center line.

Accordingly, while embodiments have been particularly shown and described, many variations may be made therein. Other combinations of features, functions, elements, and/or properties may be used. Such variations, whether they are directed to different combinations or directed to the same combinations, whether different, broader, narrower, or equal in scope, are also included.

INDUSTRIAL APPLICABILITY

The methods and apparatus described in the present disclosure are applicable to lighting and other industries utilizing solid-state light-emitting devices such as LEDs for illumination.

What is claimed is:

1. A lamp assembly comprising:

a light source the rays of light from which emanate from the vicinity of a center line, the vicinity being defined as points located less than a maximum source radius from the center line, and which rays radiate predominantly into a sector of space having the center line as its vertex, a first plane that contains the center line defining a first boundary of the sector, and a second plane that contains the center line defining a second boundary of the sector, the sector being characterized by an included angle that is the angle traversing the sector between the first plane and the second plane;

a reflecting surface disposed a distance greater than the maximum source radius from the center line, the cross-section of which reflecting surface is substantially constant in size, shape, and orientation in all planes perpendicular to the center line that intersect the light source, the reflecting surface exhibiting primarily specular reflectance of light, the reflecting surface extending to intercept light emitted at angles between the angle of the first plane bounding the sector and the angle of a cutoff plane within the sector, which cutoff plane contains the center line, the reflecting surface not intercepting light at angles between the cutoff plane and the angle of the second plane bounding the sector, the shape of the reflecting surface being such that light reflected by the reflecting surface adds, on an object surface, illumination that supplements the direct illumination by light not intercepted by the reflecting surface.

2. The lamp assembly according to claim 1, wherein the shape of the reflecting surface is such that the total illumination on a flat object surface in a plane parallel to the center line, which illumination is a combination of direct illumination by light not intercepted by the reflecting surface and the supplementary illumination by light reflected by the reflecting surface, is uniform between the second plane and the cutoff plane, provided the extent of the light source along the direction of the center line is much greater than the greatest distance from the center line to the illuminated portion of the object surface.

3. The lamp assembly according to claim 1, wherein the shape of the reflecting surface is such that the total illumination on a flat object surface in a plane parallel to the center line, which illumination is a combination of direct illumination by light not intercepted by the reflecting surface and the supplementary illumination by light reflected by the reflecting surface, varies linearly with distance along a line on the object surface between the second plane and the cutoff plane, provided the extent of the light source along the direction of the center line is much greater than the greatest distance from the center line to the illuminated portion of the object surface.

4. The lamp assembly according to claim 1, further comprising a heat sink having a mounting surface to which the light source can be attached and through which heat can flow from the light source into the heat sink.

5. The lamp assembly according to claim 4, further comprising an end piece attached to an end of the heat sink and having a surface substantially perpendicular to the center line, which surface faces toward the other end of the heat sink and which surface is either specularly or diffusively reflective.

6. The lamp assembly according to claim 4, further comprising an elongated hole penetrating through a portion of the heat sink having a curved outer surface, the direction of penetration and the direction of elongation both being in a plane perpendicular to the center line.

7. The lamp assembly according to claim 4, wherein a portion of the heat sink functions as a blind by intercepting light emitted by the light source into a portion of the sector between the second boundary and a blind edge plane containing the center line and traversing the interior of the portion of the sector between the second boundary and the cutoff plane.

8. The lamp assembly according to claim 1, wherein the intersection of the reflecting surface with a plane perpendicular to the center line follows a continuous curve.

9. The lamp assembly according to claim 1, wherein the reflecting surface is mottled, wrinkled, dimpled, faceted, or otherwise textured sufficiently to produce a limited amount of diffusion or patterning of the reflected light.

10. The lamp assembly according to claim 1, wherein the light source radiates into a half-space, the included angle of the sector being approximately 180 degrees, and wherein the intersection of the reflecting surface with a plane perpendicular to the center line has a tangent at a first point at which the intersection meets the first boundary of the sector, the tangent being perpendicular to the first plane and the first point being, of all points on the intersection, the one closest to the center line.

* * * * *